US005894198A

United States Patent [19]

Miki et al.

[11] Patent Number: 5,894,198

[45] Date of Patent: Apr. 13, 1999

[54] MAGNETRON WITH A FIFTH HARMONIC CHOKE

[75] Inventors: Kazuki Miki, Himeji; Noriyuki Murao, Hyogo-ken; Setsuo Hasegawa, Kasai, all of Japan

[73] Assignee: Sanyo Electric Co., Ltd., Moriguchi, Japan

[21] Appl. No.: 08/818,016

[22] Filed: Mar. 14, 1997

[30] Foreign Application Priority Data

| | | | |
|---|---|---|---|
| Mar. 18, 1996 | [JP] | Japan | 8-061131 |
| May 27, 1996 | [JP] | Japan | 8-132186 |

[51] Int. Cl.[6] ..... H01J 23/54

[52] U.S. Cl. ..... 315/39.51; 315/39.53

[58] Field of Search ..... 315/39.51, 39.53

[56] References Cited

FOREIGN PATENT DOCUMENTS

| | | | |
|---|---|---|---|
| 0 327 116 | 8/1989 | European Pat. Off. . | |
| 1-167936 | 7/1989 | Japan | 315/39.51 |
| 2-144826 | 6/1990 | Japan . | |
| 3-201343 | 9/1991 | Japan | 315/39.51 |
| 2 243 018 | 10/1991 | United Kingdom . | |

OTHER PUBLICATIONS

Derwent Publications Ltd., JP 63 261 651 A(Hitachi Ltd.) Oct. 28, 1988, Abstract.

European Search Report for European Application No. 97104532.3 dated Jun. 1997.

*Primary Examiner*—Robert Pascal

*Assistant Examiner*—Justin P. Bettendorf

*Attorney, Agent, or Firm*—Armstrong, Westerman, Hattori, McLeland & Naughton

[57] ABSTRACT

A magnetron including: an anode cylinder in which a plurality of vanes are formed, a filament provided at a center of the anode cylinder, a top hat which supports an upper end of the filament, a top lead for connecting the top hat at an upper end of the top lead, an end hat which supports a lower end of the filament, an end lead for connecting the end hat at an upper end of the end lead, a stem metal hermetically sealed at an open end of the anode cylinder through a pole piece, and a choke disposed inside the stem metal, wherein the choke is disposed approximately in a position of wavelength of a predetermined high frequency from the top hat in a distance along a surface of the top lead. It is possible to suppress generation of undesired high frequency, especially of the fifth high frequency, from the input portion.

20 Claims, 5 Drawing Sheets

MAGNETRON WITH A FIFTH HARMONIC CHOKE

BACKGROUND OF THE INVENTION

The present invention relates to a magnetron for generating microwaves, and more particularly, to a magnetron for suppressing the generation of higher harmonics of microwave.

A structure relating to a conventional magnetron is shown in FIG. 6. In FIG. 6, numeral 21 denotes an anode cylinder. In the radially inward direction of the anode cylinder 21, there are formed a plurality of vanes 22, and a filament 23 is disposed on the central axis. The part 24 is a stem metal, which is hermetically sealed at the open end of the anode cylinder 21. The part 25 is a choke which is press-fitted to the inner surface of the stem metal 24. The filament 23 is subjected to high temperature by the applied voltage to discharge thermion, and renders the surrounding area to a high temperature by radiant heat. The discharged thermion shows circulating movement in the operating space formed between the lateral surface of the vane 22 and the filament 23 to oscillate microwave.

In general, in the magnetron, there are generated fundamental harmonic as oscillating microwaves. Besides the fundamental harmonic component, there are generated higher harmonics having a frequency of multiple of integers thereof, and these higher harmonics are radiated outside from the input portion. Recently, especially needs for preventing leakage of the electric waves from apparatuses, especially those utilizing magnetron have become greater, and above all, suppression of radiation of higher harmonics is demanded. By the way, in the magnetron to be used for the electronic oven, when the higher harmonic component is radiated from the input side, the component is propagated in the electronic oven in the same manner as in the case of the fundamental harmonics. Because of short wavelength, the higher harmonics might provide difficulty to shield the electric waves in various parts of the electronic oven, and cause leakage outside.

In view of the above, in order to suppress generation of the higher harmonics by the magnetron per se, there has been developed a technique to suppress optional higher harmonics by forming a ¼ wavelength type choke on the input portion (e.g., Japanese Unexamined Patent Publication No. 144826/1990).

In such magnetron, there has not been considered what would be the effect of suppression of the higher harmonics when the position of arrangement of choke is changed.

Accordingly, it is an object of the present to provide a magnetron capable of suppressing generation of undesired higher harmonics from the input portion, especially of suppressing generation of the fifth higher harmonic.

SUMMARY OF THE INVENTION

In accordance with the first aspect of the present invention, there is provided a magnetron including: an anode cylinder in which a plurality of vanes are formed in a radially inward direction of the anode cylinder, a filament provided at a center of the anode cylinder, a top hat which supports an upper end of the filament and connects the filament at a lower end of the top hat, a top lead for connecting the top hat at an upper end of the top lead, an end hat which supports a lower end of the filament and connects the filament at an upper end of the end hat, an end lead for connecting the end hat at an upper end of the end lead, a stem metal which is hermetically sealed at an open end of the anode cylinder through a pole piece, and a choke disposed inside the stem metal.

The choke is disposed approximately in a position of wavelength of a predetermined high frequency from the top hat in a distance along a surface of the top lead.

In accordance with the second aspect of the present invention, there is provided a magnetron including: an anode cylinder in which a plurality of vanes are formed in a radially inward direction of the anode cylinder, a filament provided at a center of the anode cylinder, a top hat which supports an upper end of the filament and connects the filament at a lower end of the top hat, a top lead for connecting the top hat at an upper end of the top lead, an end hat which supports a lower end of the filament and connects the filament at an upper end of the end hat, an end lead for connecting the end hat at an upper end of the end lead, a stem metal which is hermetically sealed at an open end of the anode cylinder through a pole piece, and a choke disposed inside the stem metal.

The choke is disposed approximately in a position of ½ of wavelength of a predetermined high frequency from the end hat in a distance along a surface of the end lead.

In accordance with the third aspect of the present invention, there is provided a magnetron including: an anode cylinder in which a plurality of vanes are formed in a radially inward direction of the anode cylinder, a filament provided at a center of the anode cylinder, a top hat which supports an upper end of the filament and connects the filament at a lower end of the top had, a top lead for connecting the top hat at an upper end of the top lead, an end hat which supports a lower end of the filament and connects the filament at an upper end of the end hat, an end lead for connecting the end hat at an upper end of the end lead, a stem metal which is hermetically sealed at an open end of the anode cylinder through a pole piece, and a choke disposed inside the stem metal.

The choke is disposed approximately in a position of wavelength of a predetermined high frequency from a connecting portion between the top hat and the filament in a distance along a surface of the top lead.

In accordance with the fourth aspect of the present invention, there is provided a magnetron including: an anode cylinder in which a plurality of vanes are formed in a radially inward direction of the anode cylinder, a filament provided at a center of the anode cylinder, a top hat which supports an upper end of the filament and connects the filament at a lower end of the top hat, a top lead for connecting the top hat at an upper end of the top lead, an end hat which supports a lower end of the filament and connects the filament at an upper end of the end hat, an end lead for connecting the end hat at an upper end of the end lead, a stem metal which is hermetically sealed at an open end of the anode cylinder through a pole piece, and a choke disposed inside the stem metal.

The choke is disposed approximately in a position of ½ of wavelength of a predetermined high frequency from a contacting portion between the end hat and the filament in a distance along a surface of the end lead.

In the above-discussed structural arrangements, it is desirable that a curled portion is formed at an end of the choke on the filament side, and the curled portion is brought into contact with the stem metal.

DETAILED DESCRIPTION

Figure 1:
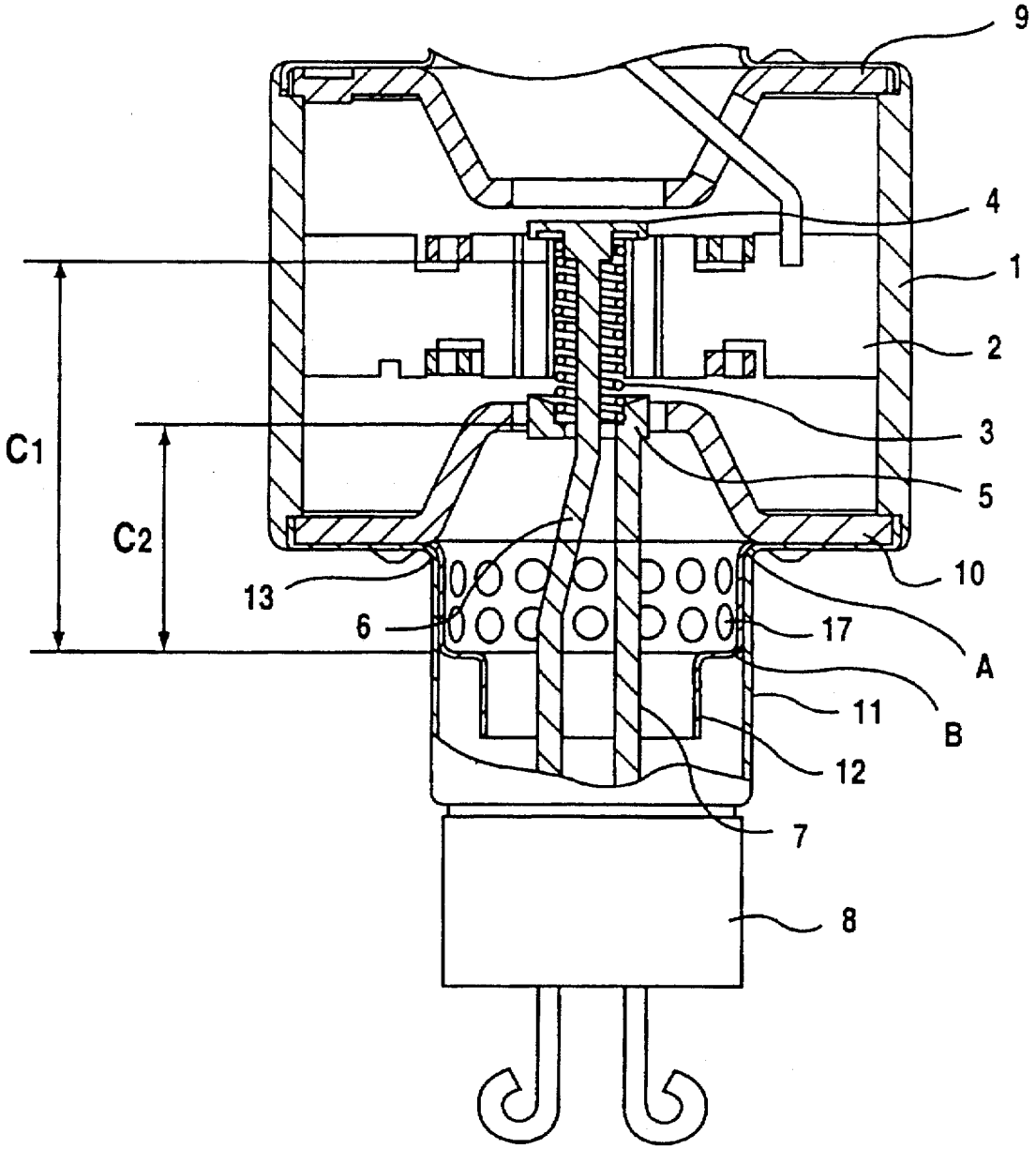
FIG. 1 is a cross-sectional view of a main portion which shows an embodiment of the present invention.

In FIG. 1, an embodiment of the present invention is shown, and description is made hereinafter based on the drawings.

The part 1 indicates an anode cylinder, which forms vanes 2 in a radially inward direction of the anode cylinder, and a filament 3 is disposed at a center of the anode cylinder 1. The filament 3 is connected at its upper and lower ends by the top hat 4 and the end hat 5, respectively, and supported by them. The top hat 4 and the end hat 5 are connected to the upper ends of the top lead 6 and the end lead 7, respectively; and the top lead 6 and the end lead 7 are fixed to a ceramic metal 8 at their lower portions.

The parts 9 and 10 are pole pieces fixed to the upper and lower open ends of the anode cylinder 1, in which a stem metal 11 is hermetically sealed through the input side pole piece 10. The part 12 is a choke disposed concentrically with the stem metal 11 by press-fitting inside the stem metal 11. At an end of the choke 12 on the filament 3 side, a curled portion 13 is formed. Positioning is made by bringing the curled portion 13 into contact with the stem metal 11. The curled portion 13 regulates the position of the choke 12 by coming near to or into contact with the pole piece 10 in fitting the stem metal 11 to the pole piece 10, and there is no apprehension to cause displacement of position by temperature variation or vibration during the operation of the magnetron.

Accordingly, there is no need to provide means for preventing position displacement (such as, brazing), and it is possible to set the choke 12 securely at a low cost.

Figure 2:
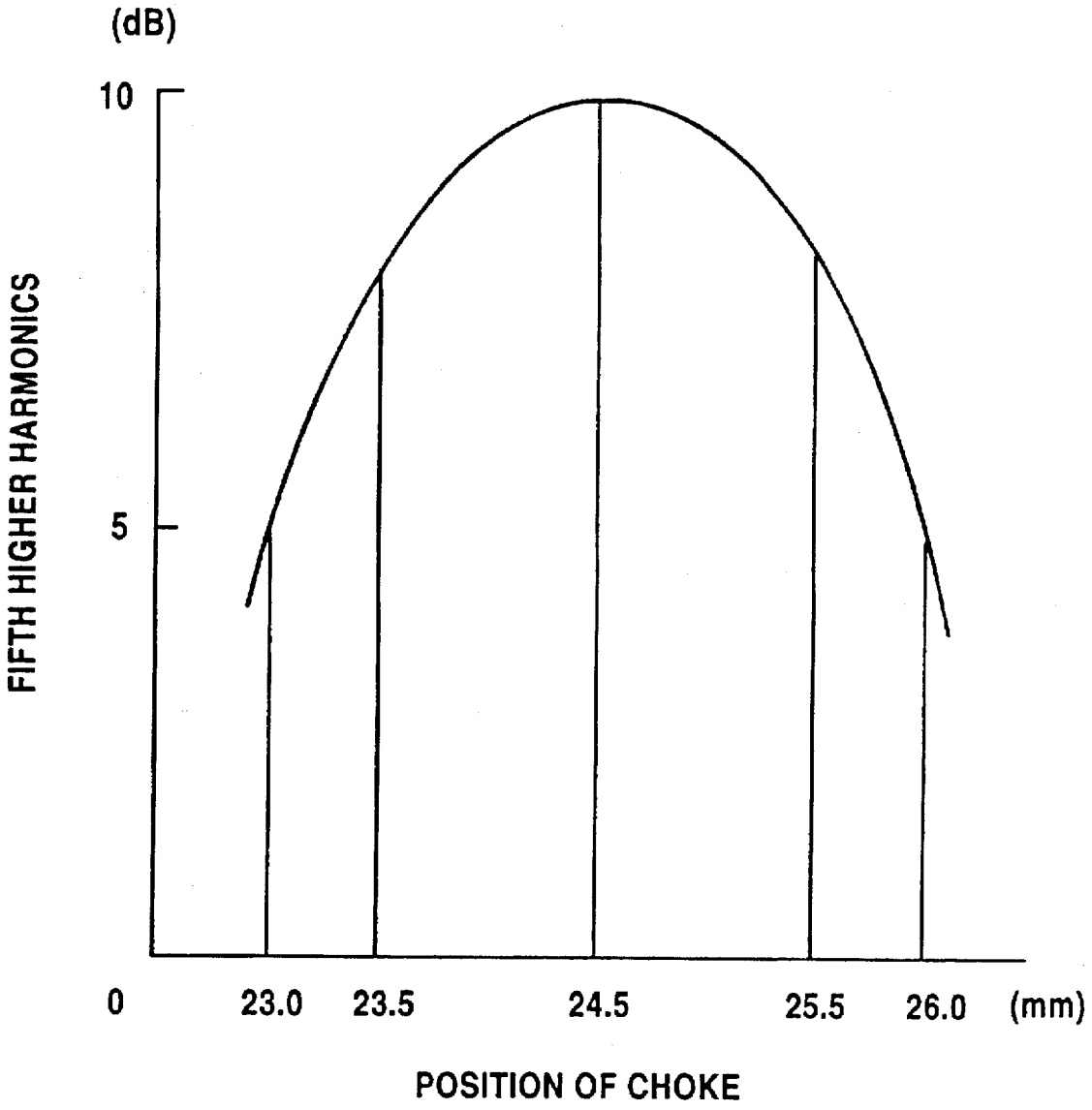
FIG. 2 is a characteristic view to show relation between choke disposition position and suppression effect of the fifth higher harmonics.

FIG. 2 shows how the fifth higher harmonic are suppressed in the case where the distance C1 in a distance along the surface of the top lead 6 from the connecting portion between the filament 3 and the top hat 4 to the disposition position of the choke 12 is varied in the embodiment. It is the characteristics diagram prepared on the basis of the experimental data. As shown in FIG. 2, the suppression effect of the fifth higher harmonic is maximized in the case where the position of the choke 12 is set to a wavelength (24.5 mm) of the fifth higher harmonic; and the farther the distance from the position is, the less the suppression effect is.

From the above results, it is concluded that the range having the suppression effect of the fifth higher harmonic in the disposition position C1 of the choke 12 from the connecting portion between the filament 3 and the top hat 4 is C1=24.5±1.5 mm.

Further, it is more desirable that the disposition is made in the range of C1=24.5±1 mm.

Further, in the above-described embodiment, in the case where the distance C2, in a distance along the surface of the end lead 7 from the connecting portion between the filament 3 and the end hat 5 to the disposition position of the choke 12, is varied, the characteristics similar to those shown in FIG. 2 are obtained. That is, the suppression effect of the fifth higher harmonic is maximized in the case where the position of the choke 12 is set to a ½ wavelength (12.25 mm) of the fifth higher harmonic; and the farther the distance from the position is, the less the suppression effect is.

Similar to the above results, the range having the suppression effect of the fifth higher harmonics in the disposition position C2 of the choke 12 from the end hat 5 is C2=12.25±1.5 mm. Further, it is more desirable that the disposition is made in the range of C2=12.25±1 mm.

Furthermore, the effect is greater in the case where the choke 12 satisfies both the above conditions; i.e., where it is disposed in the range of C1=24.5±1.5 mm and C2=12.25±1.5 mm. More desirably, the range is C1=24.5±1 mm and C2=12.25±1 mm.

Figure 6:
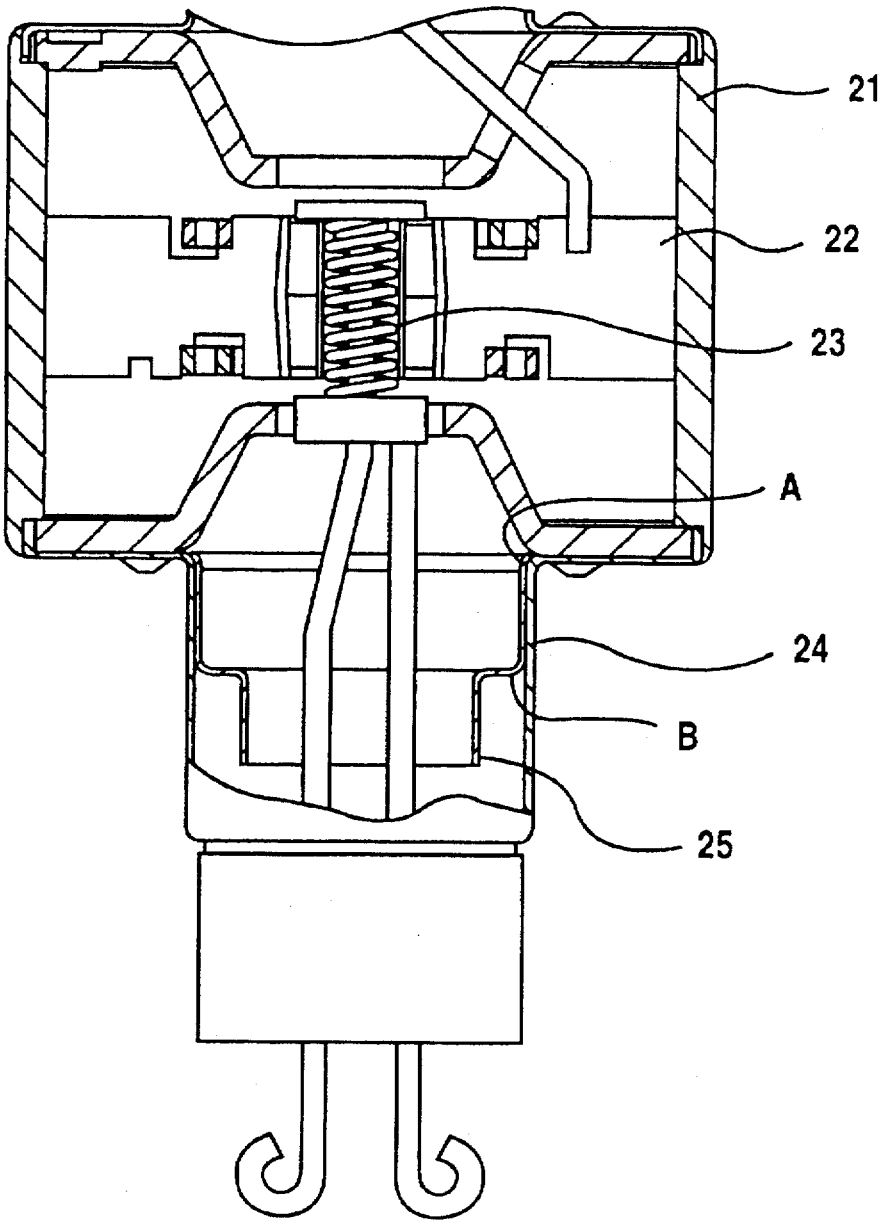
FIG.6 PRIOR ART
FIG. 6 is a cross-sectional view of a main portion in the conventional magnetron.

Furthermore, in the magnetron shown in FIG. 6, in order to make the circulation movement of thermion possible, the anode cylinder is subjected to exhaustion of air inside. In this case, the gas lying between the surface of the choke 25 to be press-fitted and the stem metal 24 is discharged from the circular peripheral ends A and B of the press-fitted surface of the choke 25. However, since the gap between the surface of the choke 25 to be press-fitted and the stem metal 24 is very small, in the press-fitting surface of the choke 25 into the stem metal 24, the farther the distance from A and B, the resistance of gas discharging significantly increases. The gas discharging resistance becomes the largest in the intermediate region between A and B. Especially in that portion, exhaustion of gas is not easy, and there have been cases where the gas remains between the press-fitted surface of the choke 25 and the stem metal 24. The residual gas in such case flows into the anode cylinder 21 due to the lapse of time or the temperature rise in the anode cylinder during the operation, giving rise to troubles such as the inhibitation the circulation movement of thermion or the generation of combustion of the vane 22 or filament 23 which is in high temperature state during operation; thereby leading to the lowering of yield in process. As a countermeasure against such problems, conventionally there is a method of removing gas by extending the time for exhaust processing, but such method has not provided sufficient result.

In view of the above, in the present embodiment, as shown in FIG. 1, there are provided, as a gas discharging means, a plurality of approximately circular holes 17 on the surface of the choke 12 to which the stem metal 11 is press-fitted.

With the above-discussed holes 17 there can be formed, as a gas discharging means, an opening on the outer periphery of the hole, and the distance between the gas discharging means can be shortened compared with the conventional one (distance between A and B). Accordingly, the gas discharging resistance in the intermediate portion between the gas discharging means at which the gas discharging resistance becomes the maximum is made smaller than before, and the rate of the gas to remain on the surface of the choke 12 to be press-fitted to the stem metal 11 after the exhaust processing is lowered. As a result, it is possible to obtain the prescribed vacuum in the anode cylinder 1 with greater certainty.

Figure 3:
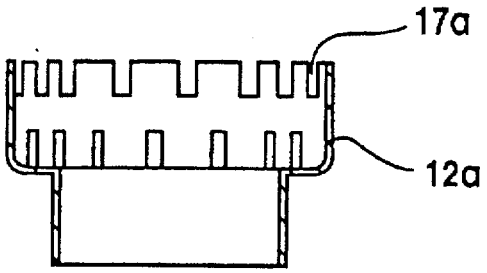
FIG. 3 is a view to show another example of the gas discharging means in the present invention.
Figure 4:
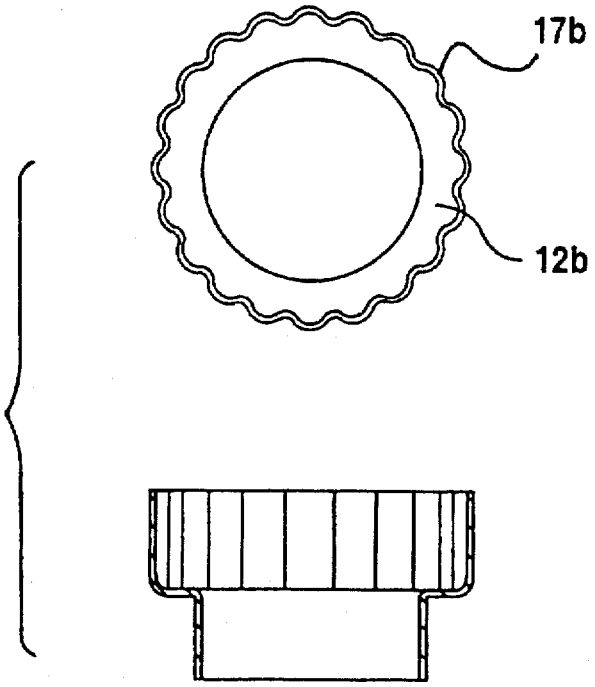
FIG. 4 is a view to show yet another example of the gas discharging means in the present invention.
Figure 5:
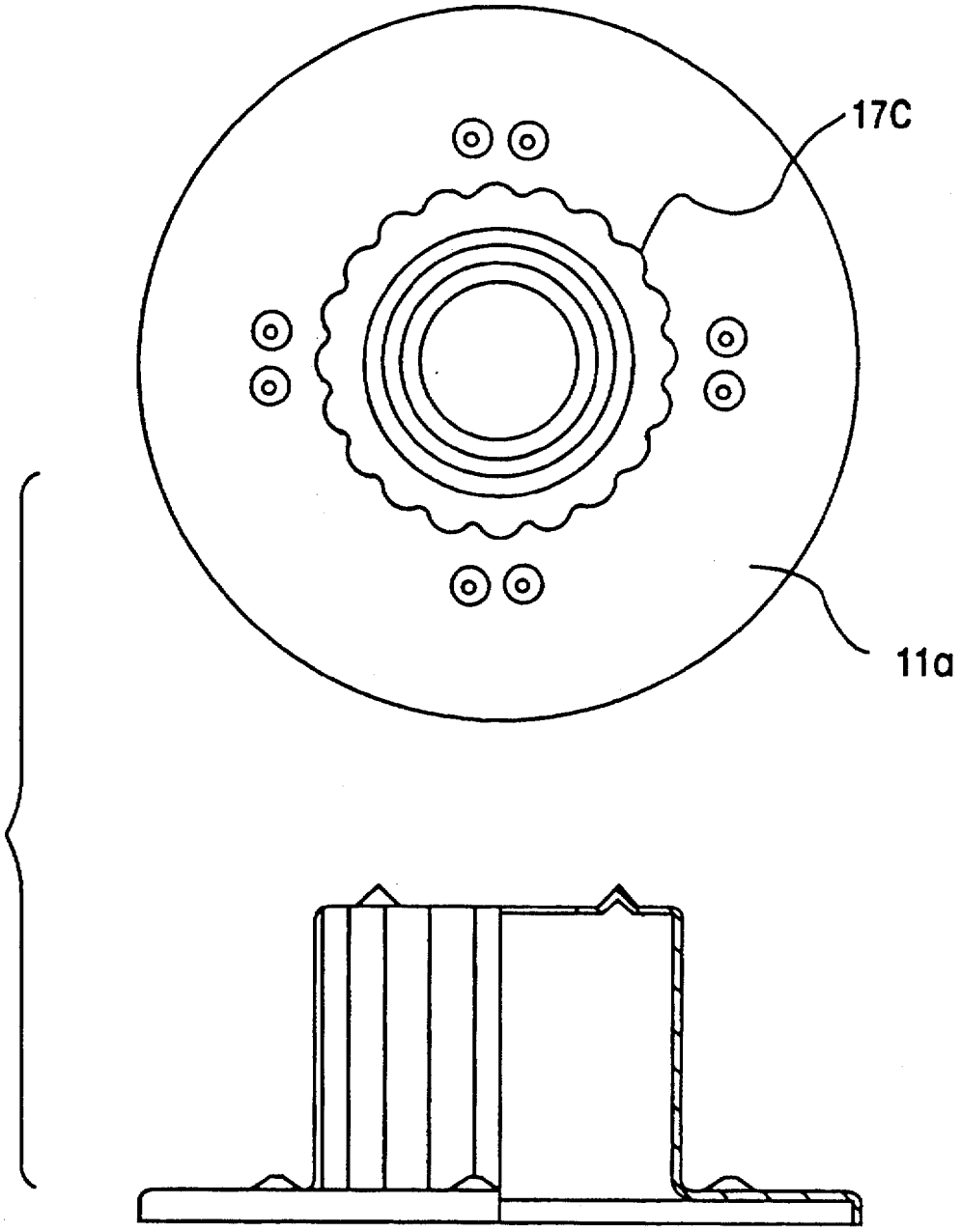
FIG. 5 is a view to show still further example of the gas discharging means in the present invention.

In the above embodiment, there is formed a hole on the surface of the choke 12 to be press-fitted to the stem metal 11. However, as in FIG. 3, a plurality of slit-like notches **17*a* might be provided on the surface of the choke 12 to be press-fitted to the stem metal 11, or the notches 17*a* might be formed in other shape. Alternatively, as in FIG. 4, the press-fitting surface of the choke 12***b* might be formed in a corrugated shape 17*b*, or as in FIG. 5, the press-fitting surface of the stem metal 11*a* to which the choke is press-fitted might be of a corrugated shape 17*c*.

According to the present invention, it is possible to suppress generation of undesired high frequency, especially of the fifth high frequency, from the input portion.

Furthermore, when gas discharging means is formed on the press-fitting surface between the choke and the stem metal, the gas discharging is facilitated and the predetermined vacuum in the anode cylinder can be obtained with greater certainty.

While the invention has been particularly shown and described in reference to preferred embodiments thereof, it will be understood by those skilled in the art that changes in form and details may be made therein without departing from the spirit and scope of the invention.

What is claimed is:

1. A magnetron including: an anode cylinder in which a plurality of vanes are formed in a radially inward direction of the anode cylinder, a filament provided at a center of the anode cylinder, a top hat which supports an upper end of the filament and connects the filament at a lower end of the top hat, a top lead for connecting the top hat at an upper end of the top lead, an end hat which supports a lower end of the filament and connects the filament at an upper end of the end hat, an end lead for connecting the end hat at an upper end of the end lead, a stem metal which is hermetically sealed at an open end of the anode cylinder through a pole piece, and a choke disposed inside the stem metal, wherein the choke is disposed substantially in a position of wavelength of a predetermined high frequency from the top hat in a distance along a surface of the top lead and substantially suppresses fifth higher harmonic.

2. The magnetron of claim 1, wherein a curled portion is formed at an end of the choke on the filament side, and the curled portion is brought into contact with the stem metal.

3. The magnetron of claim 1, wherein gas discharging means is formed on a press-fitting surface between the choke and the stem metal.

4. The magnetron of claim 3, wherein the gas discharging means is formed on a press-fitting surface of the choke.

5. The magnetron of claim 3, wherein the gas discharging means is formed on a press-fitting surface of the stem metal.

6. A magnetron including: an anode cylinder in which a plurality of vanes are formed in a radially inward direction of the anode cylinder, a filament provided at a center of the anode cylinder, a top hat which supports an upper end of the filament and connects the filament at a lower end of the top hat, a top lead for connecting the top hat at an upper end of the top lead, an end hat which supports a lower end of the filament and connects the filament at an upper end of the end hat, an end lead for connecting the end hat at an upper end of the end lead, a stem metal which is hermetically sealed at an open end of the anode cylinder through a pole piece, and a choke disposed inside the stem metal, wherein the choke is disposed substantially in a position of ½ of wavelength of a predetermined high frequency from the end hat in a distance along a surface of the end lead and substantially maximizes suppression effect of fifth higher harmonic.

7. The magnetron of claim 6, wherein a curled portion is formed at an end of the choke on the filament side, and the curled portion is brought into contact with the stem metal.

8. The magnetron of claim 6, wherein gas discharging means is formed on a press-fitting surface between the choke and the stem metal.

9. The magnetron of claim 8, wherein the gas discharging means is formed on a press-fitting surface of the choke.

10. The magnetron of claim 8, wherein the gas discharging means is formed on a press-fitting surface of the stem metal.

11. A magnetron including: an anode cylinder in which a plurality of vanes are formed in a radially inward direction of the anode cylinder, a filament provided at a center of the anode cylinder, a top hat which supports an upper end of the filament and connects the filament at a lower end of the top hat, a top lead for connecting the top hat at an upper end of the top lead, an end hat which supports a lower end of the filament and connects the filament at an upper end of the end hat, an end lead for connecting the end hat at an upper end of the end lead, a stem metal which is hermetically sealed at an open end of the anode cylinder through a pole piece, and a choke disposed inside the stem metal, wherein the choke is disposed substantially in a position of wavelength of a predetermined high frequency from a connecting portion between the top hat and the filament in a distance along a surface of the top lead and substantially suppresses fifth higher harmonic.

12. The magnetron of claim 11, wherein a curled portion is formed at an end of the choke on the filament side, and the curled portion is brought into contact with the stem metal.

13. The magnetron of claim 11, wherein gas discharging means is formed on a press-fitting surface between the choke and the stem metal.

14. The magnetron of claim 13, wherein the gas discharging means is formed on a press-fitting surface of the choke.

15. The magnetron of claim 13, wherein the gas discharging means is formed on a press-fitting surface of the stem metal.

16. A magnetron including: an anode cylinder in which a plurality of vanes are formed in a radially inward direction of the anode cylinder, a filament provided at a center of the anode cylinder, a top hat which supports an upper end of the filament and connects the filament at a lower end of the top hat, a top lead for connecting the top hat at an upper end of the top lead, an end hat which supports a lower end of the filament and connects the filament at an upper end of the end hat, an end lead for connecting the end hat at an upper end of the end lead, a stem metal which is hermetically sealed at an open end of the anode cylinder through a pole piece, and a choke disposed inside the stem metal, wherein the choke is disposed approximately in a position of ½ of wavelength of a predetermined high frequency from a contacting portion between the end hat and the filament in a distance along a surface of the end lead and substantially maximizes suppression effect of fifth higher harmonic.

17. The magnetron of claim 16, wherein a curled portion is formed at an end of the choke on the filament side, and the curled portion is brought into contact with the stem metal.

18. The magnetron of claim 16, wherein gas discharging means is formed on a press-fitting surface between the choke and the stem metal.

19. The magnetron of claim 18, wherein the gas discharging means is formed on a press-fitting surface of the choke.

20. The magnetron of claim 18, wherein the gas discharging means is formed on a press-fitting surface of the stem metal.

* * * * *